US008057380B2

(12) United States Patent
Kuo et al.

(10) Patent No.: US 8,057,380 B2
(45) Date of Patent: Nov. 15, 2011

(54) PROCESS FOR OPERATING AN OPEN THERMOTHERAPY DEVICE

(75) Inventors: Arthur Kuo, Lübeck (DE); Tobias Otte, Lübeck (DE)

(73) Assignee: Drägerwerk Aktiengesellschaft, Lübeck (DE)

( * ) Notice: Subject to any disclaimer, the term of this patent is extended or adjusted under 35 U.S.C. 154(b) by 1093 days.

(21) Appl. No.: 11/856,268

(22) Filed: Sep. 17, 2007

(65) Prior Publication Data

US 2008/0076961 A1 Mar. 27, 2008

(30) Foreign Application Priority Data

Sep. 21, 2006 (DE) ..... 10 2006 044 671

(51) Int. Cl.
*A61G 11/00* (2006.01)

(52) U.S. Cl. ..... 600/22; 237/3; 454/188

(58) Field of Classification Search ..... 600/21–22; 454/188–190; 128/846; 119/300–317; 5/652.1, 5/652.2, 724, 726; *A61G 11/00*
See application file for complete search history.

(56) References Cited

U.S. PATENT DOCUMENTS

2008/0234538 A1* 9/2008 Lehnhaeuser ..... 600/22

FOREIGN PATENT DOCUMENTS

DE 10320195 B4 12/2004
DE 102004016080 A1 8/2005

* cited by examiner

*Primary Examiner* — Charles A Marmor, II
*Assistant Examiner* — Catherine E Burk
(74) *Attorney, Agent, or Firm* — McGlew and Tuttle, P.C.

(57) ABSTRACT

A process is provided for operating a thermotherapy device with a bed surface (10) and with discharge channels for conditioned air in the longitudinal direction of the bed surface (10) and on the foot side (3) thereof as well as with an exhaust unit (11) above the bed surface (10). The air being discharged from the discharge channels is directed towards the exhaust unit (11) such that the discharge angle α changes continuously as a function of the distance between the exhaust unit (11) and the site of the discharge flow from the discharge channels, the elevation angle β changes continuously as a function of the distance between the exhaust unit (11) and the site of the discharge flow from the discharge channels, and the value of the velocity of the discharge flow changes continuously as a function of the site of the discharge flow from the discharge channels.

15 Claims, 2 Drawing Sheets

PROCESS FOR OPERATING AN OPEN THERMOTHERAPY DEVICE

CROSS REFERENCE TO RELATED APPLICATIONS

This application claims the benefit of priority under 35 U.S.C. §119 of German Patent Application DE 10 2006 044 671.2 filed Sep. 21, 2006, the entire contents of which are incorporated herein by reference.

FIELD OF THE INVENTION

The present invention pertains to a process for operating an open thermotherapy device.

BACKGROUND OF THE INVENTION

Contrary to closed incubators, open thermotherapy devices for prematurely born and newborn patients offer a substantially better access for care and therapy procedures at the patient. Open thermotherapy devices are also called open patient care units. However, the tempering and conditioning that is right for the patient represents a technical challenge that continues to exist in such thermotherapy devices.

According to DE 103 20 195 B4 or DE 10 2004 016 080 A1, the microclimate above the bed surface of an open thermotherapy device is brought about by air flows from discharge channels along the sides of the bed surface. To minimize the energy expenditure, the air flows are returned or recirculated especially through an exhaust device arranged fittingly on the head side above the bed surface.

Regardless of whether one-layer or two-layer air flows are used on the particular sides of the bed surface, the discharge flows are directed at a constant angle to the bed surface and/or at a constant angle to the head-side exhaust. Moreover, the velocity distributions of the air flows along the particular discharge channels remain constant. Due to the constant angles and constant velocities in the course of the sides of the bed surface, shears develop between the individual air flows, which lead to turbulence and consequently to an extensive instability of the microclimate. In addition, the constant velocity in terms of direction and value leads to a discharge flow that is directed inhomogeneously towards the exhaust device.

SUMMARY OF THE INVENTION

The object of the present invention is to provide a better process for operating an open thermotherapy device such that the microclimate above the bed surface is stable for a long time, so that reduced energy expenditure is needed.

According to the invention, a process is provided for operating a thermotherapy device with a bed surface and with discharge channels for conditioned air in the longitudinal direction of the bed surface and on the foot side thereof as well as with an exhaust unit above the bed surface. According to the process the air is discharged from the discharge channels and is directed towards the exhaust unit such that

- the discharge angle $\alpha$ changes as a function of the distance between the exhaust unit and the site of discharge from the discharge channels;
- the elevation angle $\beta$ changes as a function of the distance between the exhaust unit and the site of discharge from the discharge channels; and
- the value of the velocity of the discharge flow changes as a function of the site of discharge from the discharge channels.

With the invention, the location of the exhaust unit relative to the discharge channels determines the discharge angle and elevation angle as well as the velocity of the discharge flow.

The direction of the discharge flow in the middle region of the foot side may be set at right angles to the foot side and the discharge angle $\alpha$ increases with the path length towards the corners of the foot side.

The discharge flow at the level of the exhaust unit may be set at right angles to the bed surface side and the discharge angle $\alpha$ increases with the path length of each lateral discharge channel up to the corresponding corner until it reaches its greatest deflection when reaching the foot side.

The value of the discharge flow may increase with increasing distance from the exhaust unit.

The elevation angle $\beta$ between the bed surface and the particular discharge flow along the bed surface may decrease with increasing distance between the side of the discharge flow and the site of the exhaust in the exhaust unit.

The lateral and foot-side discharge angles $\alpha$ are identical in the area of the corners (45° relative to the lateral sides). The values of the velocity of the discharge flow from the discharge channels along the lateral bed surface and on the foot side in the area of the corners may advantageously be identical.

The discharge flow may be set by means of lamellae that are adjustable in terms of direction and distance.

The value of the velocity of the discharge flow can be set between 0.05 m/sec and 1.2 m/sec.

The improved orientation of the air flows is achieved by continuously changing the discharge angle (changing the discharge angle of each discharge channel relative to an adjacent discharge channel) along the sides around the bed surface. In addition, adaptation of the velocities over the sides along the outlets ensures that the discharge flows meet each other with a low shear.

An exemplary embodiment will be explained below on the basis of the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
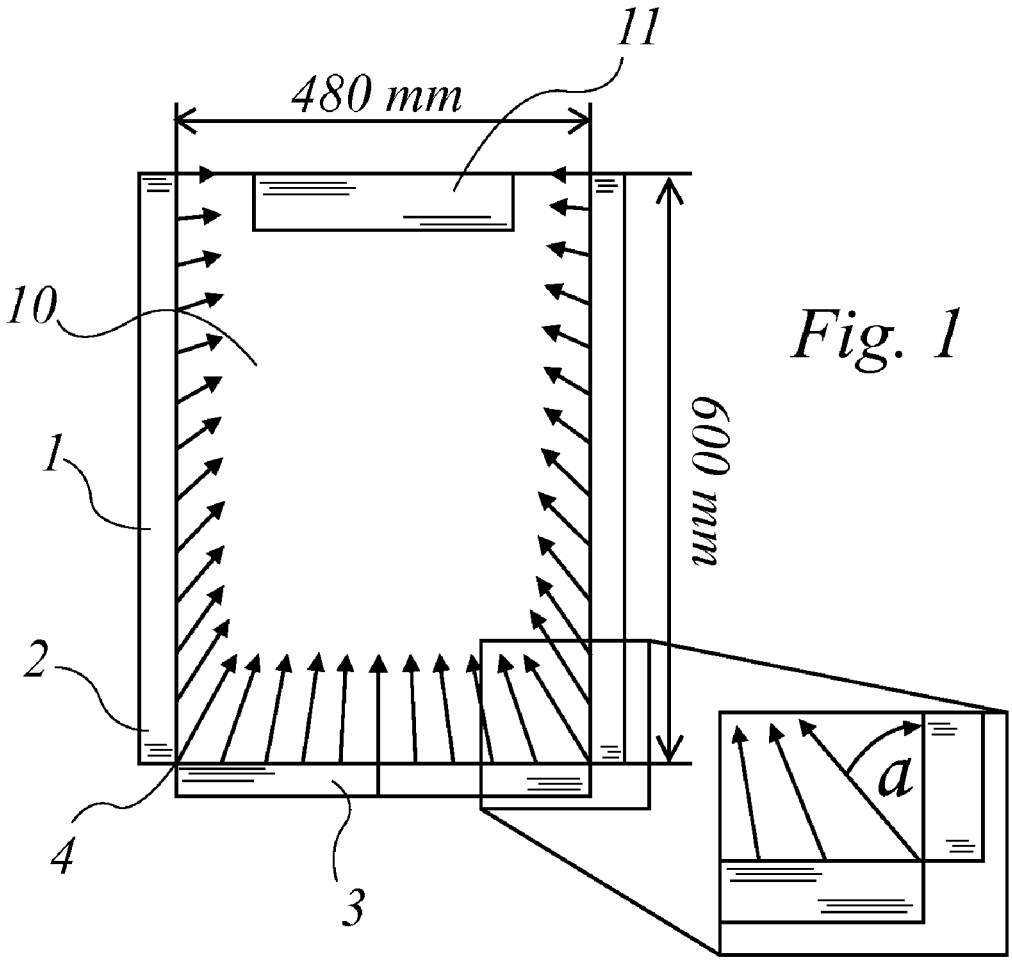
FIG. 1 is a top view of an open thermotherapy device shown schematically.

Referring to the drawings in particular, the thermotherapy device, also called a patient care unit, has circumferential discharge channels indicated by flow arrows in the area of the bed surface 10 for air conditioned in terms of humidity and/or temperature in the longitudinal direction along the two longer (lateral) sides and on the foot side 3. An exhaust device 11 is driven, for example, by means of a fan located in the interior of the device under the bed surface 10 of the device and is not visible from the outside. The exhaust device 11 has an intake above the bed surface 10 and is in flow connection with the discharge channels and optionally with the ambient air, as is described, for example, in DE 103 20 195 B4, is located in the head area at the top in FIG. 1. The sides 1 have discharge channels each with flow indicated by arrows in terms of value and direction. At the head end of each of the lateral sides 1, the discharge flow of the discharge channel is at right angles to the lateral side 1. The discharge angle α decreases with the path length from the head end to the corners 4 of each lateral side 1. The foot-side discharge channel has, in the middle of the foot side 3, a discharge flow, which is likewise indicated by arrows in terms of value and direction, at right angles to the foot side 3. The discharge angle α increases with the path length to the corners 4 of the foot side 3. The lateral discharge angle α is in the vicinity of the head at right angles to the bed surface side 1 and changes continuously (with each adjacent discharge being different) with the path length of the lateral discharge channel until it reaches its greatest deflection 2 when reaching the foot side 3. The lateral and foot-side discharge angles α are preferably identical in the area of the corners 4.

The continuously variable discharge angles α of the discharge flow along the bed surface 10 can be embodied technically, for example, with a construction with guide blades mounted rigidly at the foot between two parallel plates. The guide blades are mounted freely on a rod by means of a bolt with a defined distance from the foot. The bolt of the last guide blade is rigidly connected to the plates, but it can still rotate about its longitudinal axis. The loosely mounted bolts rotatable about the longitudinal axis in each guide blade can now rotate about their feet during a tilting motion of the rod and thus set an angle α varying depending on the distance from the axis of rotation of the rod.

Figure 2:
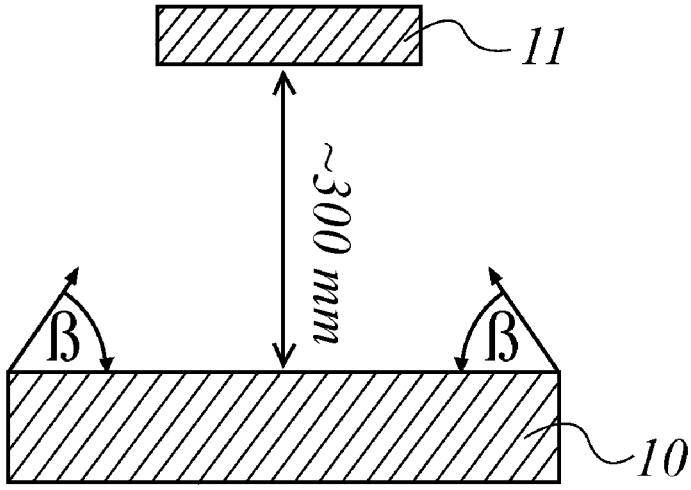
FIG. 2 is a sectional view at right angles to the longitudinal direction of the thermotherapy device from FIG. 1.

The elevation angle β corresponding to FIG. 2 between the bed surface 10 and the flow shown schematically as an arrow may be constant or variable along a particular side at the bed surface 10, for example, as a function of the distance of the discharge flow from the site of exhaust in the exhaust unit 11. A reduction of the angle β with increasing distance between the site of discharge of the flow and the exhaust unit 11 is preferred in this case, in particular.

In addition to the direction of flow, the value of the velocity is also continuously variable as a function of the site of discharge from the discharge channels along the bed surface 10.

Figure 3:
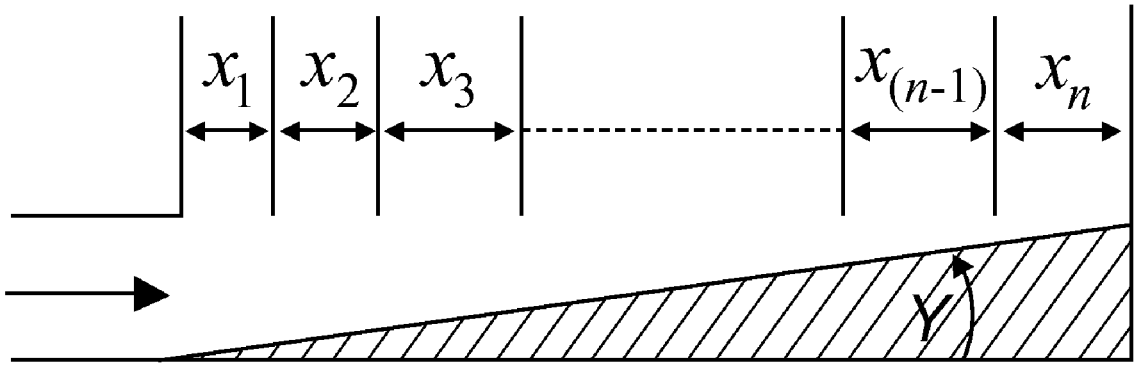
FIG. 3 is a schematic diagram of the generation of a variable velocity distribution for a discharge channel along the bed surface of a thermotherapy device.

For example, the air flow being delivered is guided for this purpose, according to the schematic diagram in FIG. 3, laterally into a flow channel with a bottom plate at a settable angle γ, so that discharge channels arranged laterally thereto with continuously variable diameters $x_1$ through $x_n$ correspondingly build up back pressures which are variable with the flow and which lead to a corresponding distribution of the mass flow being discharged with a velocity distribution associated therewith.

FIGS. 1 and 2 show typical quantitative data for dimensioning a thermotherapy device.

Three different embodiment variants of the thermotherapy device will be summarized below in Cases 1 through 3:

Case 1:

The value of the velocity of the discharge flow depends on the distance from the exhaust unit 11, so that this velocity is low on the sides close to the head (~0.2 m/sec). It increases in the course of the sides 1 of the bed surface up to the corners 4 (~0.5 m/sec). The discharge flows always remain directed towards the center of the exhaust unit 11. Thus, they are at right angles to the particular side (90°) at the head ends of the bed surface sides 1. The deflection then increases with the path length; the angle α decreases. The angle β of the discharge flows towards the bed surface 10 is ~45° at the head ends of the sides and likewise decreases with the path length (~20°).

The value of the discharge velocity and the angles α and β of the bed surface sides 1 and of the foot side 3 are identical in the foot-side corners 4 only. The value of the discharge velocity slightly decreases up to the middle of the foot side 3 (0.46 m/sec). The angle α decreases further towards the middle of the foot side 3, so that the discharge flow is at right angles to the foot side 3 in the middle of the foot side 3 (0°). The angle β remains constant over the length of the foot side 3.

Case 2:

The value of the velocity of the discharge flow at the corners 4 of the foot side 3 is 0.4 m/sec. The value of the velocity of the discharge flow increases to 0.6 m/sec towards the middle. The angle β is constant (~30°). The angle α increases from the middle of the foot side 3 (0°) towards the corners 4 (~15°).

The discharge velocity and the angles α and β of the bed surface sides 1 and the foot side 3 are not identical in this case.

The velocity of the discharge flow at the foot-side corners 4 of the bed surface sides 1 is ~0.1 m/sec and increases to 0.3 m/sec towards the sides near the head. The angle β remains constant (50°) over the side lengths. The angle α decreases from the corners near the head (90°) towards the foot-side corners 4 (25°).

Case 3 with β Constant Over the Path Lengths:

The value of the velocity of the discharge flow at the corners near the head is 0.3 m/sec. It increases to 0.55 m/sec over the lateral path lengths. The velocity over the foot side 3 is constant at 0.55 m/sec. The angle β is constantly 55° on the sides and 30° on the foot side 3. The angle α is at right angles to the particular side (90°) at the corners near the head and decreases to 30° with the path length. The angle α has a deflection of 5° at the corners 4 of the foot side 3 and it equals 0° in the middle.

While specific embodiments of the invention have been shown and described in detail to illustrate the application of the principles of the invention, it will be understood that the invention may be embodied otherwise without departing from such principles.

What is claimed is:

1. A process for operating a thermotherapy device, the process comprising the steps of:

providing a bed surface;

providing discharge channels for conditioned air in the longitudinal direction of the bed surface and on a foot side of the bed surface;

providing an exhaust unit above the bed surface;

directing air being discharged from the discharge channels towards the exhaust unit such that:

a discharge angle changes continuously as a function of a distance between the exhaust unit and the site of discharge from the discharge channels;

a elevation angle changes continuously as a function of the distance between the exhaust unit and the site of discharge from the discharge channels; and a value of the velocity of the discharge flow changes continuously as a function of a location of the discharge channels.

2. A process in accordance with claim 1, wherein the discharge angle of the discharge flow in a middle region of the foot side is set at a right angle to the foot side and the discharge angle increases continuously towards the comers of the foot side.

3. A process in accordance with claim 1, wherein the discharge angle of the discharge flow at a level of the exhaust unit is set at right angles to the bed surface side and the discharge angle of each successive discharge channel increases continuously along the longitudinal direction of the bed up to the corresponding comer until it reaches a greatest deflection upon reaching the foot side.

4. A process in accordance with claim 1, wherein the value of the velocity of the discharge flow increases continuously with increasing distance from the exhaust unit.

5. A process in accordance with claim 1, wherein the elevation angle between the bed surface and the particular discharge flow along the bed surface decreases with increasing distance between the site of the discharge flow and the site of the exhaust in the exhaust unit.

6. A process in accordance with claim 1, wherein longitudinal and foot-side discharge angles are identical in the area of the corners.

7. A process in accordance with claim 1, wherein the values of the velocity of the discharge flow from the discharge channels along the bed surface and on the foot side in the area of the corners are identical.

8. A process in accordance with claim 1, wherein the discharge flow is set by means of lamellae that are adjustable in terms of direction and distance.

9. A process in accordance with claim 1, wherein the value of the velocity of the discharge flow can be set between 0.05 m/sec and 1.2 m/sec.

10. A process for operating a thermotherapy device, the process comprising the steps of:

providing a bed surface with a head side, a first lateral side, a second lateral side and a foot side;

arranging a plurality discharge channels, one after the other, along the first lateral side;

arranging a plurality discharge channels, one after the other, along the second lateral side;

arranging a plurality discharge channels, one after the other, along the foot side;

providing an exhaust unit above the bed surface near said head side;

discharging air from said discharge channels along the first lateral side with a discharge angle relative to the first lateral side changing in each successive adjacent discharge channel in a direction toward said foot side and with an elevation angle changing in each successive adjacent discharge channel in a direction toward said foot side and with a flow velocity changing in each successive adjacent discharge channel in a direction toward said foot side;

discharging air from said discharge channels along the second lateral side with a discharge angle relative to the second lateral side changing in each successive adjacent discharge channel in a direction toward said foot side and with an elevation angle changing in each successive adjacent discharge channel in a direction toward said foot side and with a flow velocity changing in each successive adjacent discharge channel in a direction toward said foot side; and discharging air from said discharge channels along the foot side with a discharge angle relative to the foot side changing in each successive adjacent discharge channel in both directions away from a center of the foot side and with an elevation angle changing in each successive adjacent discharge channel in both directions away from the center of the foot side and with a flow velocity changing in each successive adjacent discharge channel in both directions away from the center of the foot side.

11. A process in accordance with claim 10, wherein the discharge angle of the direction of the discharge flow in a middle region of the foot side is set at a right angle to the foot side and the discharge angle increases from the middle towards the first lateral side and the second lateral side.

12. A process in accordance with claim 11, wherein the elevation angle decreases with increasing distance between the discharge flow and the exhaust unit.

13. A process in accordance with claim 11, wherein the value of the velocity of the discharge flow can be set between 0.05 m/sec and 1.2 m/sec.

14. A process in accordance with claim 10, wherein:

the discharge angle nearest the exhaust unit from said discharge channels along the first lateral side is perpendicular to the first lateral side and the discharge angle relative to the first lateral side is smaller in each successive adjacent discharge channel; and the discharge angle nearest the exhaust unit from said discharge channels along the second lateral side is perpendicular to the second lateral side and the discharge angle relative to the second lateral side is smaller in each successive adjacent discharge channel.

15. A process in accordance with claim 10, wherein the value of the velocity of the discharge flow increases continuously with increasing distance from the exhaust unit.

* * * * *